US008776295B2

(12) United States Patent
Myers et al.

(10) Patent No.: US 8,776,295 B2
(45) Date of Patent: Jul. 15, 2014

(54) MULTI-NEEDLE QUILTING TAPE GUIDE APPARATUS AND METHOD

(75) Inventors: Terrance L. Myers, Joplin, MO (US); David K. Winton, Jasper, MO (US); John A. Garrett, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 13/474,247

(22) Filed: May 17, 2012

(65) Prior Publication Data

US 2012/0297547 A1 Nov. 29, 2012

Related U.S. Application Data

(60) Provisional application No. 61/488,844, filed on May 23, 2011.

(51) Int. Cl.
*A47C 17/00* (2006.01)
*A47C 23/04* (2006.01)

(52) U.S. Cl.
USPC ..... 5/737; 5/703; 5/717

(58) Field of Classification Search
CPC .... A47C 31/08; A47C 27/066; A47C 27/002; A47C 27/15; A47C 27/05
USPC ..... 5/703, 717, 737, 739
See application file for complete search history.

(56) References Cited

U.S. PATENT DOCUMENTS 1,413,577 A * 4/1922 Eldredge ..... 5/739
1,762,106 A * 6/1930 Pittoni ..... 5/739
2,218,785 A * 10/1940 Boettcher ..... 112/117
2,330,192 A * 9/1943 Bednarek ..... 5/703
2,715,229 A 8/1955 Hirschman
3,234,901 A * 2/1966 Coury ..... 112/417
3,995,337 A 12/1976 Gershaw
D308,789 S * 6/1990 Hackwell ..... D6/605
5,154,130 A * 10/1992 Gribetz et al. ..... 112/292
D377,433 S * 1/1997 Funk et al. ..... D6/596
5,594,964 A * 1/1997 Boyd et al. ..... 5/502
5,603,270 A * 2/1997 White et al. ..... 112/117
5,738,029 A 4/1998 Porter et al.
5,937,463 A 8/1999 Hutton et al.
5,983,814 A 11/1999 Block
6,202,579 B1 3/2001 Olewicz et al.
6,209,468 B1 4/2001 Marcangelo et al.
6,237,517 B1 * 5/2001 Bondanza et al. ..... 112/118
6,895,878 B2 5/2005 Stutznacker
7,143,705 B2 * 12/2006 Frazer et al. ..... 112/117
7,617,556 B2 * 11/2009 Rensink ..... 5/739
7,770,530 B2 * 8/2010 James et al. ..... 112/475.08

(Continued)

*Primary Examiner* — William Kelleher
*Assistant Examiner* — Eric Kurilla
(74) *Attorney, Agent, or Firm* — Wood, Herron & Evans, LLP

(57) ABSTRACT

A multi-needle quilting machine (20) is provided with a tape or ribbon guide (30) that is operated by a method by which a narrow strip (32) is fed against a facing layer (11*a*) of a wide multi-layered material (24) as it is fed into the quilting machine. In the quilting machine (20), series of chain stitches are sewn, at least one of which joins the tape (32) and layers of the multi-layered material (24) together with the same thread in a quilting process, thereby applying the tape (32) to the quilted product in a single quilting operation without the need for a post-quilting tape application step. The tape may form a decorative strip or have unsewn sections that serve as handles for a mattress when the quilted product is formed into a mattress cover.

10 Claims, 6 Drawing Sheets

(56) References Cited

U.S. PATENT DOCUMENTS

| | | | | |
|---|---|---|---|---|
| 7,793,372 | B2 * | 9/2010 | Lean et al. | 5/740 |
| D649,387 | S | 11/2011 | Jung et al. | |
| D659,459 | S | 5/2012 | Jung et al. | |
| 2005/0028275 | A1 * | 2/2005 | Hooper, Jr. | 5/400 |
| 2010/0263128 | A1 * | 10/2010 | Lean et al. | 5/636 |
| 2012/0159715 | A1 * | 6/2012 | Jung et al. | 5/703 |

* cited by examiner

MULTI-NEEDLE QUILTING TAPE GUIDE APPARATUS AND METHOD

CROSS REFERENCE TO RELATED APPLICATIONS

The present application claims the filing benefit of U.S. Provisional Application Ser. No. 61/488,844, filed May 23, 2011, the disclosure of which is incorporated herein by reference in its entirety.

FIELD OF THE INVENTION

The present invention relates to the application of tape strips to quilted material and, particularly to the methods and devices for applying such tapes as decorative strips or handles to quilted mattress covers.

BACKGROUND OF THE INVENTION

Mattress covers are typically formed of panels of quilted material. Typically, rectangular top and bottom panels are joined around their edges by a border panel strip around the edges of a spring or foam mattress interior to form the outer covering of the mattress. Handles are often added to the mattress edges to facilitate the turning or other handling of the mattress. These handles have been added to the border panels, which are usually quilted, in a manufacturing step that occurs subsequent to any quilting process, typically before the border panel is joined to the other panels to cover the mattress.

The application of tape strips by a post-quilting sewing step has been proposed for the addition of handles to mattresses. Tape strips have also been sewn to quilted mattress panels for decorative purposes or functional or structural purposes in foaming mattress covers.

All such post-quilting steps involve some production time and add to production costs.

SUMMARY OF THE INVENTION

Primary objectives of the present invention are to simplify the mattress or other quilt production costs when tape or other material strips are to be applied to the quilted product and to reduce the costs of such production processes.

According to principles of the present invention, tape or other material strips are joined to a quilted product in the quilting process. In particular, according to embodiments of the invention, tape is applied to a mattress border panel during the border quilting process on a multi-needle quilting machine.

In the illustrated embodiments of the invention, a multi-needle quilting machine is provided with a tape guiding device that feeds a tape strip against a facing sheet of a material being quilted in the quilting machine. In the quilting machine, one or more of the series of stitches of quilting patterns that is sewn to join the layers of quilted material is also directed to attach the fed tape strip to the face of the fabric.

In particular embodiments of the invention, the stitches of the quilted pattern join a tape strip to a mattress border panel. In certain embodiments, a continuous series of stitches of the pattern joins the tape strip along sections of the length of the strip with the stitch sequences tacked at one or both ends. Then a section of the tape strip is skipped or jumped over and sewn again at a length along the strip, eight or twelve inches long, for example, to allow the tape strip in between the sewn portions of the strip to serve as a handle.

With the invention, a quilt, such as a mattress border panel, a mattress cover formed of the border panel, and a mattress are provided having tape or ribbon strips secured by the same stitches that join layers of the quilted material together. More particularly, such panels, mattress covers and mattresses are provided having handles secured by chain stitch pattern sequences that join multiple layers of quilted material together. These layers typically have a facing layer, a backing layer, a fill layer between the facing and backing layers, and a tape strip secured to the outside of the facing layer, all held together with the same chain-stitched quilted patterns.

The invention eliminates separate sewing processes or steps to apply tape to quilts, and particularly, to apply handles to border panels, mattress covers or mattresses. With the invention, mattress cover or other quilt manufacturing processes are simplified and their costs are reduced.

These and other objects and advantages of the present invention will be apparent from the following detailed description of the embodiments which are illustrated in the drawings, in which:

DETAILED DESCRIPTION OF THE DRAWINGS

In the detailed description below, parts identified by a common number followed by a letter to distinguish multiple similar ones of such parts may be referred to as a group by the number alone. For example, border panel 10 may refer to border panels 10*a*, 10*b*, . . . .

Figure 1A:
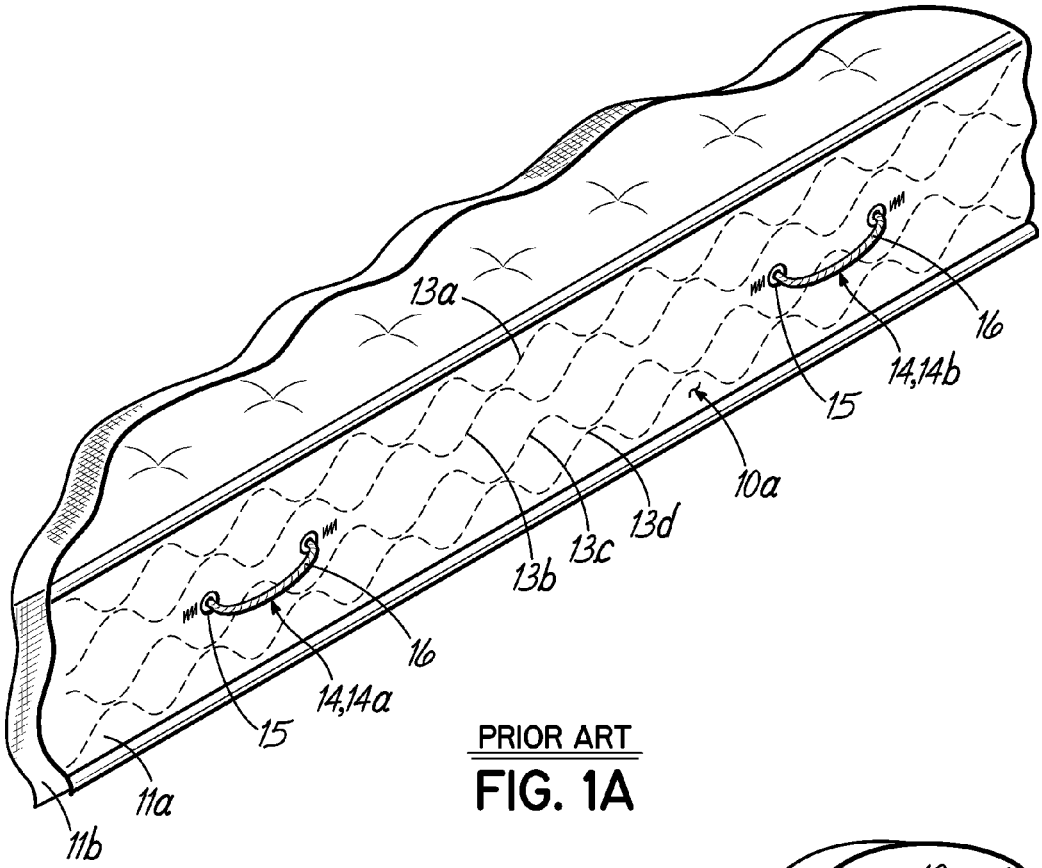
PRIOR ART FIG. 1A
FIG. 1A illustrates a length of quilted mattress border panel of the prior art having mattress handles secured thereto.

FIG. 1A shows a mattress border panel 10*a* of the prior art formed of multiple layers of material 11*a* and 11*b* that have been sewn together with sequences of stitches 13*a*, 13*b*, 13*c*, 13*d* in a quilting process. The border panel 10*a* also has handles 14 (14*a*, 14*b*) attached thereto in a subsequent manufacturing step, using grommets 15 and cord 16 secured in a separate post-quilting process.

Figure 1B:
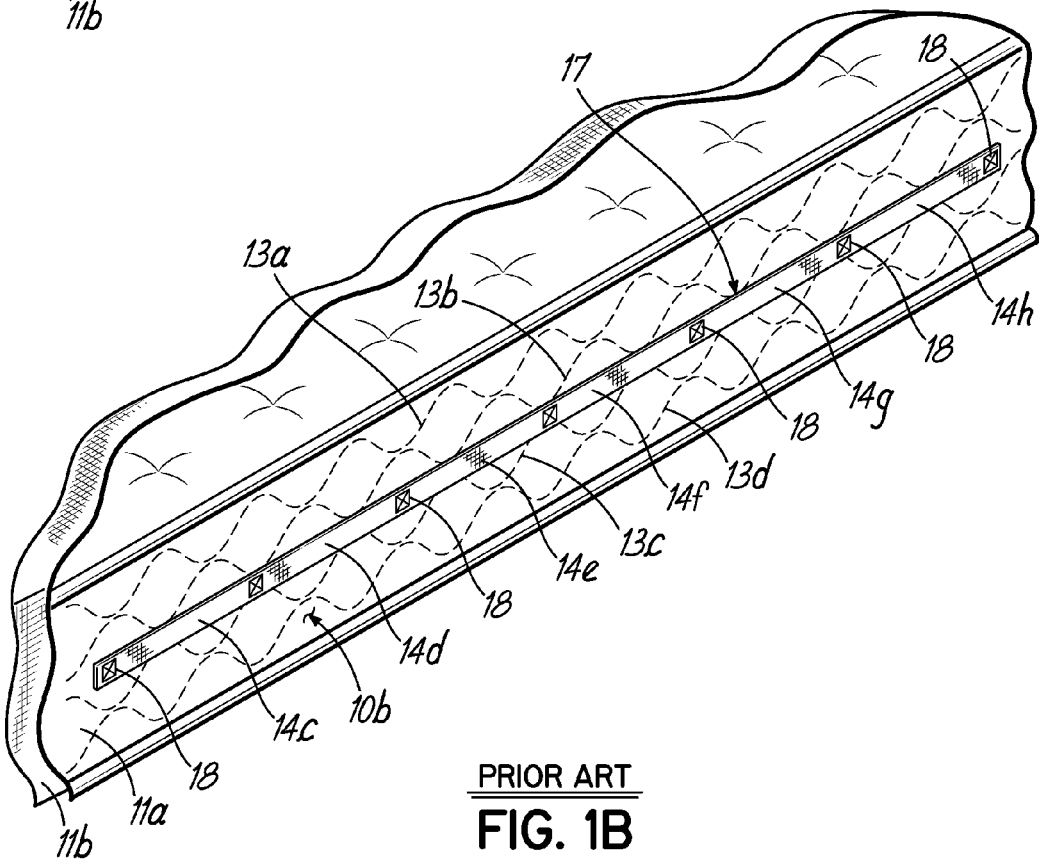
PRIOR ART FIG. 1B
FIG. 1B illustrates a length of quilted mattress border panel of the prior art having a tape strip sewn thereto to form mattress handles along the border panel.

FIG. 1B shows another mattress border panel 10*b* of the prior art formed of multiple layers of material 11*a* and 11*b* that have been sewn together with sequences of stitches 13*a*, 13*b*, 13*c*, 13*d* in a quilting process. The border panel 10*b* also has a tape or ribbon strip 17 sewn to the quilted fabric on a separate single needle quilting machine after the quilted border panel has been removed from the quilting machine. The strip 17 is attached to the quilted fabric by the application of stitch blocks 18. The sections of the tape or strip 17 between the stitch blocks 18 form handles 14 (14*c*, . . . , 14*h*) attached thereto in a subsequent manufacturing step. The stitch blocks 18 are lock-stitch sequences sewn on a traditional lock-stitch, single-needle, handle sewing machine.

Figure 2A:
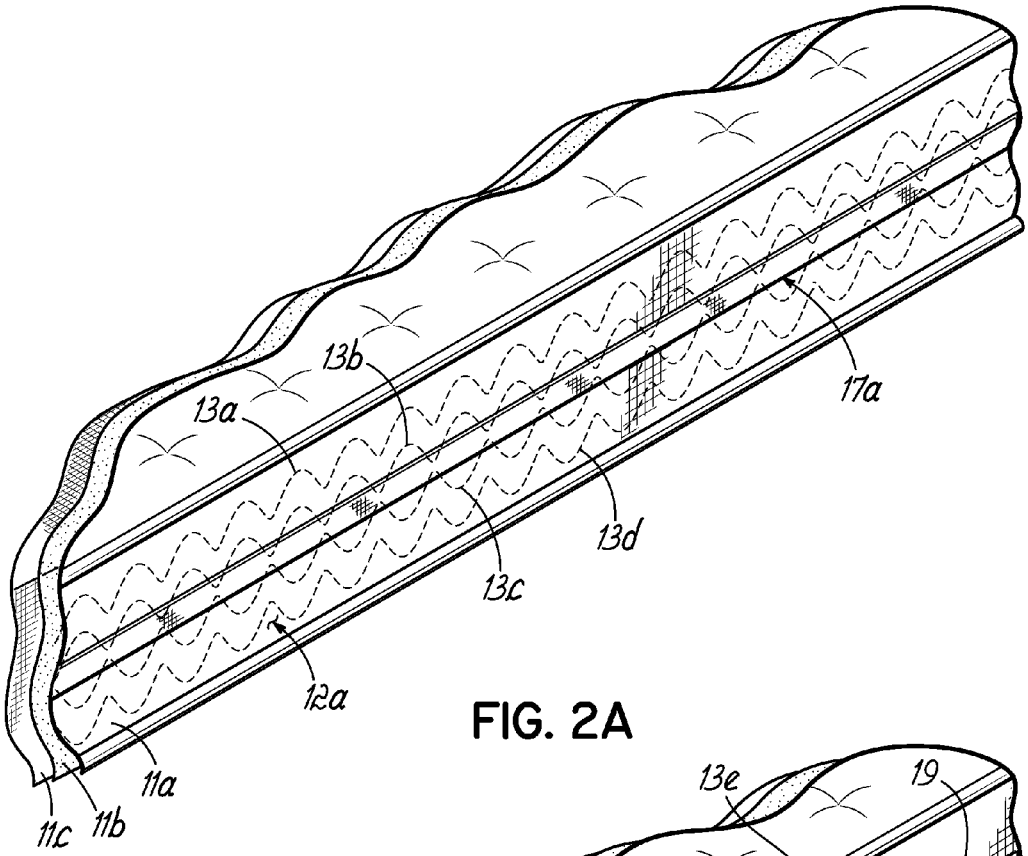
FIGS. 2A, 2B, and 2C are drawings illustrating lengths of quilted mattress border panels according to embodiments of the present invention in which the same quilting stitch sequences applied in the quilting process to attach the layers of the quilted material together also secure the tape or ribbon to the border panels to form decorative strips or mattress handles.

FIG. 2A illustrates one embodiment of a mattress border panel 12*a* formed of multiple layers of material 11*a*, 11*b* and 11*c* according to principles of the present invention. The layers of material include a facing layer 11*a*, a backing layer 11*c* and one or more fill layers 11*b* that have been sewn together with sequences of stitches 13*a*, 13*b*, 13*c*, 13*d* in a quilting process on a multi-needle quilting machine. The border panel 12*a* also has a tape or ribbon strip 17*a* sewn to the quilted fabric with the same sequences of stitches 13*a*, 13*b*, 13*c*, 13*d* that joined the layers of material 11*a*, 11*b*, and 11*c* in the quilting process on the multi-needle quilting machine. The strip 17*a*, as shown, is attached to the quilted fabric by the application of the continuous stitch sequences 13*b* and 13*c* that overlap onto the strip 17*a*. So sewn, the strip 17*a* can form a decorative strip on a mattress cover or other quilted panel secured to the top of the facing layer 11*a* with some of the same stitch sequences, namely 13*b* and 13*c*, that secure the layers 11*a*, 11*b* and 11*c* of the quilted panel 12*a* together.

Figure 2B:
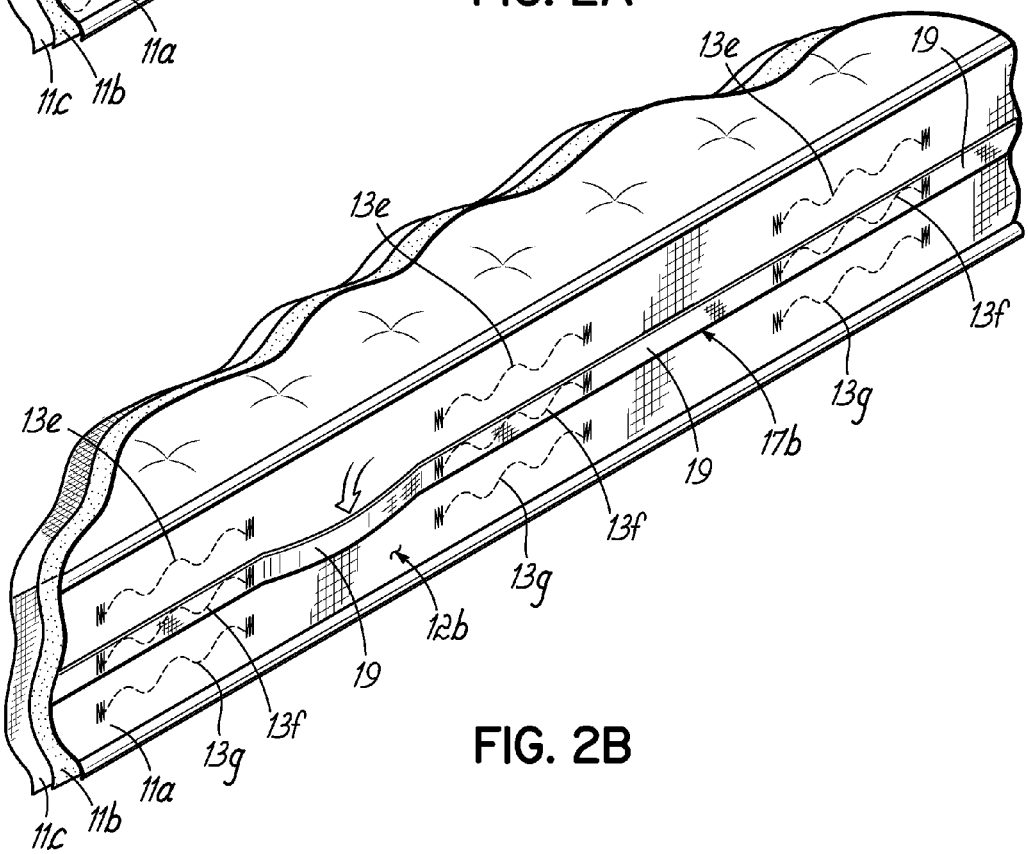

FIG. 2B illustrates another embodiment of a mattress border panel 12*b* formed of multiple layers of material 11*a*, 11*b* and 11*c* according to principles of the present invention. The layers of material include facing layer 11*a*, backing layer 11*c* and one or more fill layers 11*b* all sewn together with TACK AND JUMP™ intermittent series of stitch sequences 13*e*, 13*f*, 13*g* in a quilting process on a multi-needle quilting machine. The border panel 12*b* also has a tape or ribbon strip 17*b* sewn to the quilted fabric with one of the same sequences of stitches 13*e*, 13*f*, 13*g*, namely, the center sequence 13*f* that joined the layers of material 11*a*, 11*b* and 11*c* in the quilting process on the multi-needle quilting machine. The strip 17*b*, as shown, is attached to the quilted fabric by the application of the series of sequences of stitches 13*f* that form a tack at each end and spaced from each other along the length of the strip 17*b*, leaving a section of unstitched tape or ribbon to form handles 19 that serve as handles for a mattress when the panel 12*b* is sewn to top and bottom panels to form a mattress cover. Each of the series of chain stitch sequences are formed by a needle thread on the facing layer side of the multilayered material and a looper thread on the opposite side of the material, with at least the needle thread being cut between the sequences.

Figure 2C:
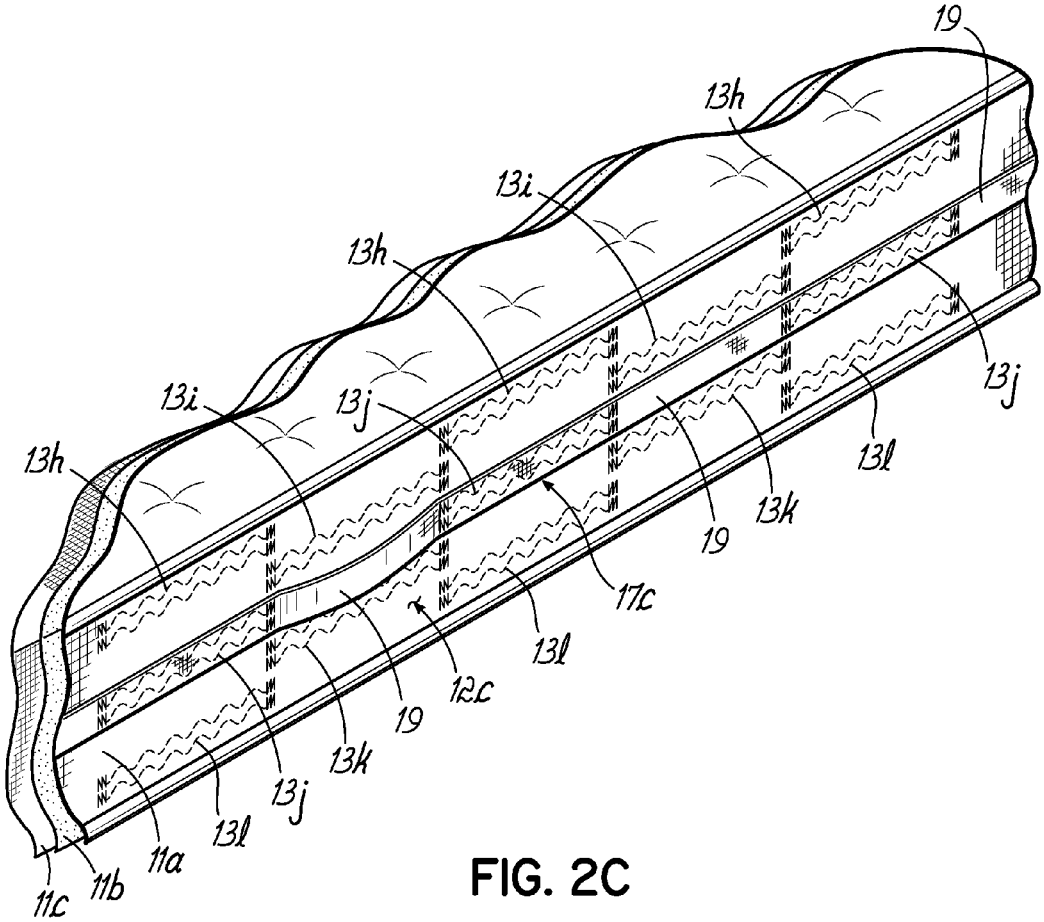

A further embodiment of a mattress border panel 12*c*, formed of multiple layers of material 11*a*, 11*b* and 11*c*, according to principles of the present invention, is illustrated in FIG. 2C. The layers of material include facing layer 11*a*, backing layer 11*c* and one or more fill layers 11*b* sewn together with TACK AND JUMP™ intermittent series of stitch sequence pairs 13*h*, 13*i*, 13*j*, 13*k*, 13*l* sewn simultaneously with multiple staggered rows of needles, in a quilting process on a multi-needle quilting machine. The border panel 12*c* has a tape or ribbon strip 17*c* sewn to the quilted fabric with one of the same sequence pairs 13*h*, 13*i*, 13*j*, 13*k*, 13*l*, namely, the center sequence pair 13*j* that joined the layers of material 11*a*, 11*b* and 11*c* in the quilting process on the multi-needle quilting machine. The strip 17*c*, as shown, is attached to the quilted fabric by the application of the series of sequence pair 13*j* tacked at each end and spaced from each other along the length of the strip 17*c*, leaving a section of unstitched tape or ribbon to form handles 19 that serve as handles for a mattress when the panel 12*c* is sewn to top and bottom panels to form a mattress cover.

The strips are generally narrow relative to the widths of the web layers of the material 11 to which they are attached. Where the border panels are, for example, 8 to 16 inches wide, the strips are typically ¾ to 2 inches wide.

Figure 3:
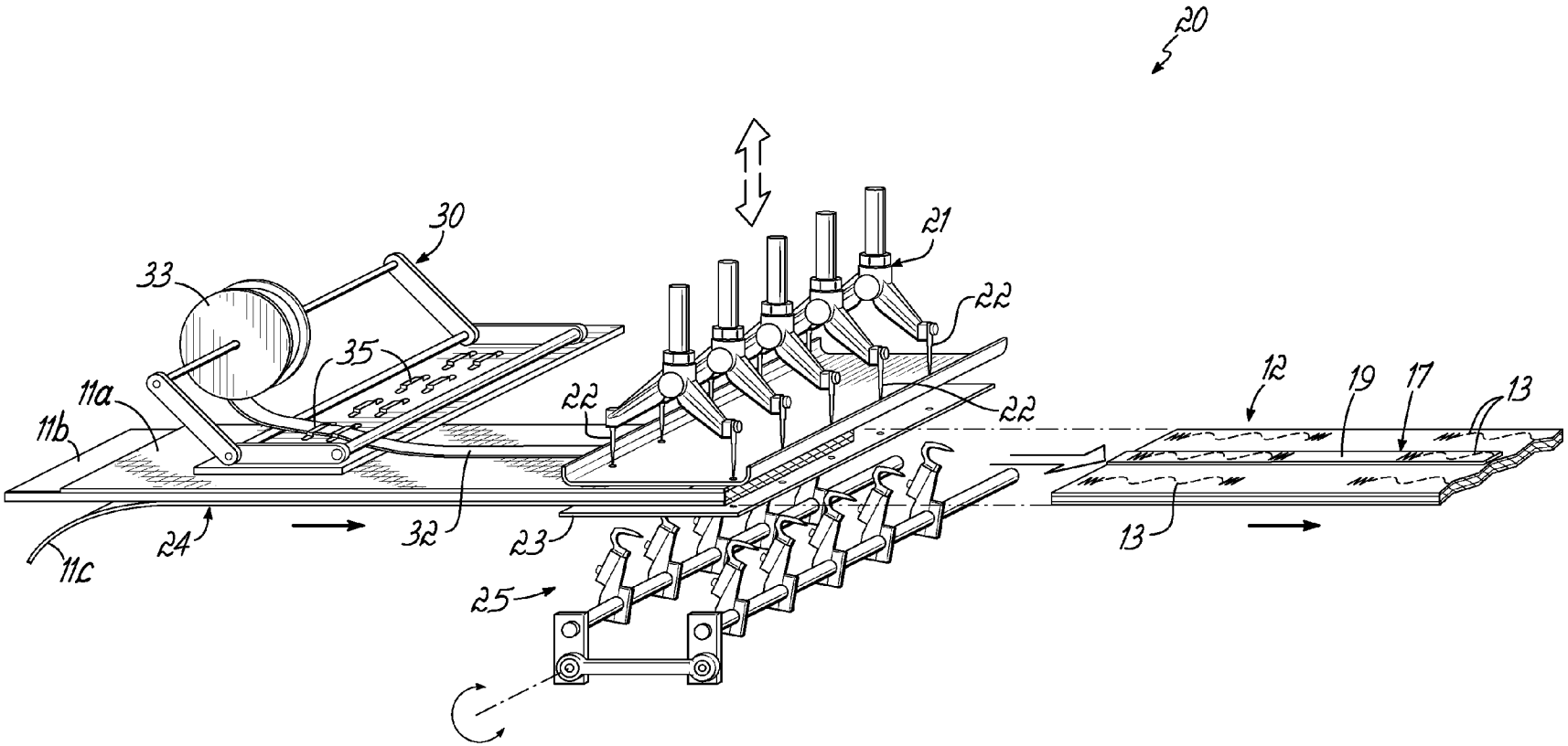
FIG. 3 is an isometric diagram depicting a multi-needle quilting machine having structure attached thereto for applying tape or ribbon to form the quilted products of FIGS. 2A to 2C during the quilting process according to principles of the present invention.
Figure 4:
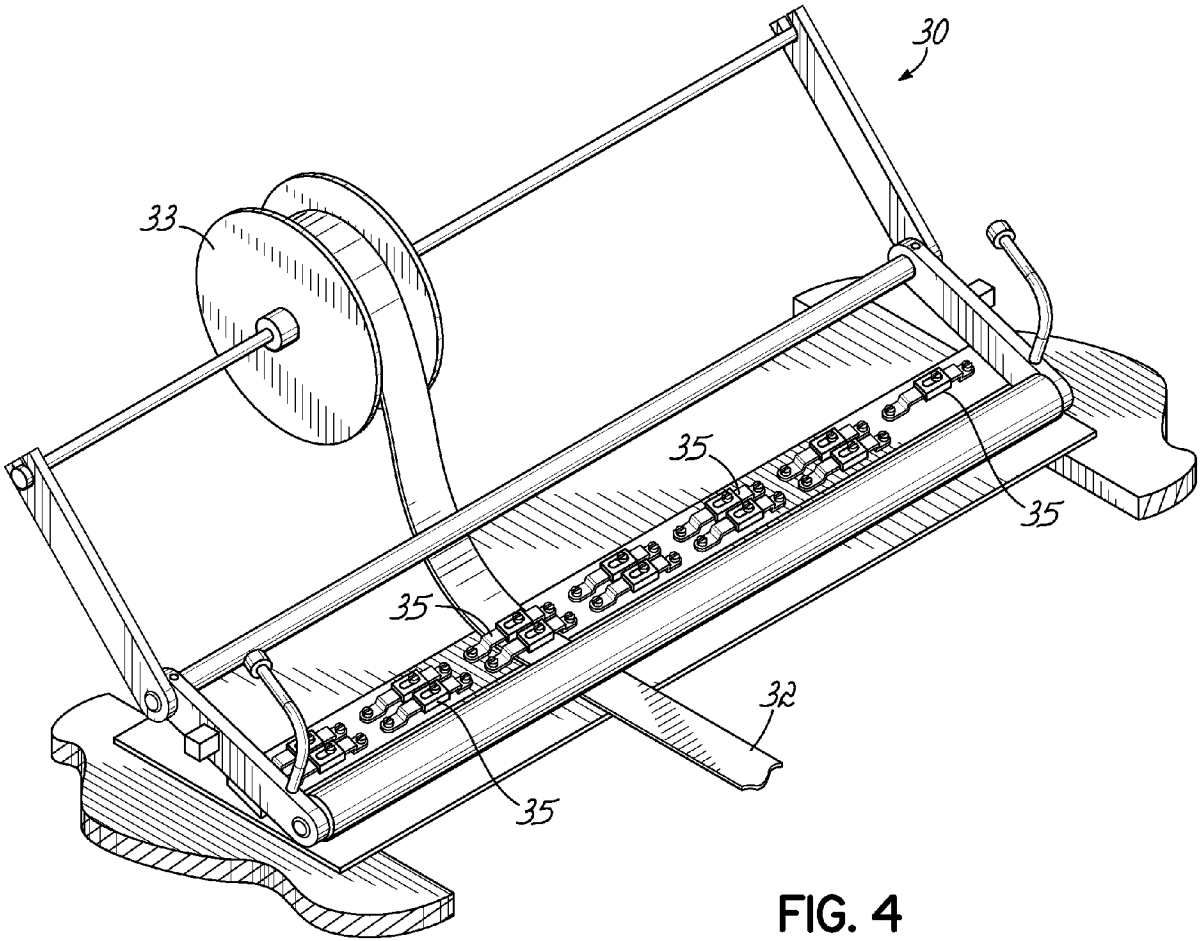
FIG. 4 is a perspective view of a tape guide attachment portion of a quilting machine according to the diagram of FIG. 3.
Figure 5:
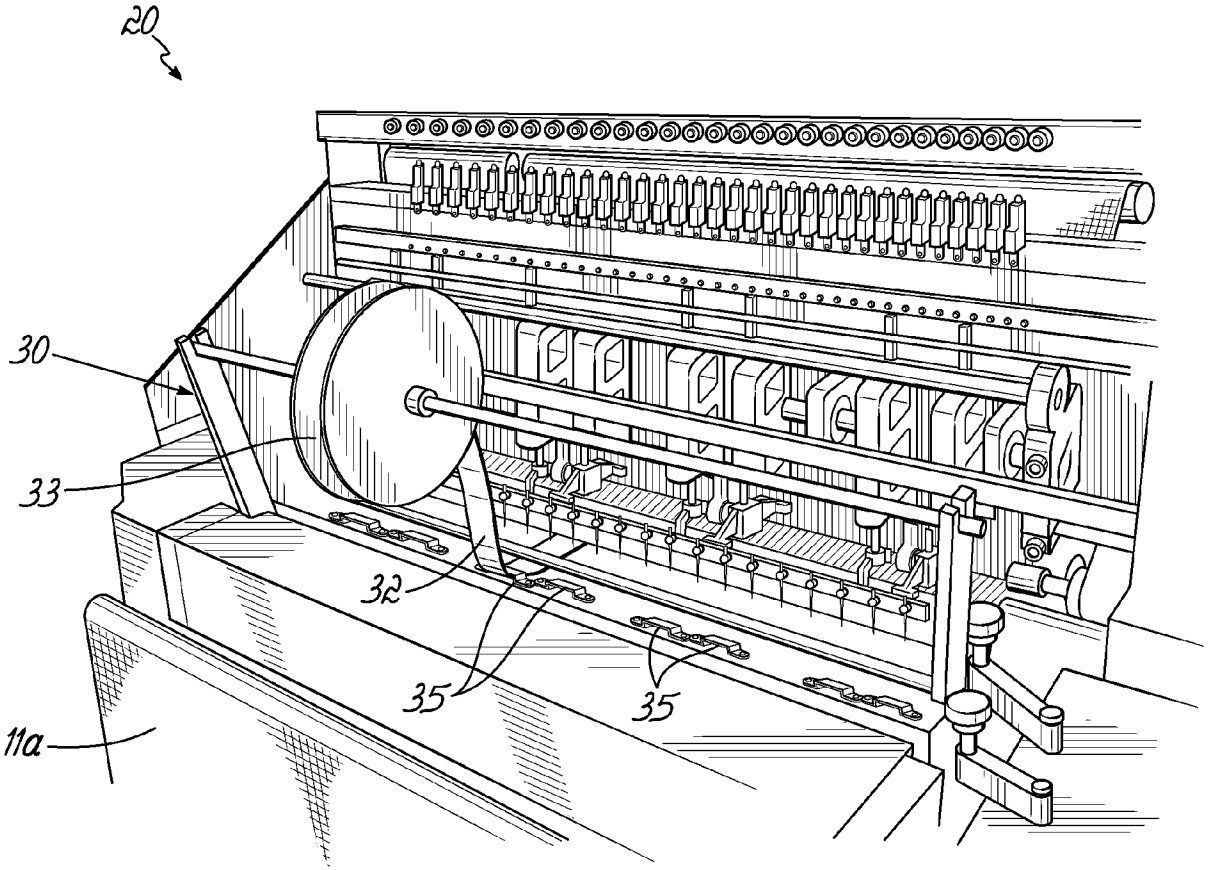
FIG. 5 is a front perspective view of a quilting machine of FIGS. 3 and 4.

The border panels 12*a*, 12*b* and 12*c* of FIGS. 2A, 2B and 2C are sewn in a border panel quilting process performed on a multi-needle quilting machine, such as machine 20 illustrated in FIGS. 3, 4 and 5. The quilting machine 20 has a frame 21 on which is mounted a plurality of rows of needles 22 that reciprocate through a needle plate 23 that supports a web of multi-layered material 24 for quilting. Below the needle plate are a plurality of rows of loopers 25 (shown in FIG. 3) that correspond to the needles 22 and operate to form a plurality of chain stitch sequences in the material 24 during a quilting process. The machine 20 in the illustrated embodiment is a narrower version of a wide format quilter that is used to quilt top and bottom panels of a mattress. The quilting machine 20 is provided for sewing border panels, such as the panels 12*a*, 12*b* and 12*c* of FIGS. 2A, 2B and 2C. Such panels may be sewn individually or in groups of two or three arranged side-by-side.

According to certain principles of the present invention, the machine 20 is provided with a tape guide attachment 30 across the front thereof to feed one or more rolls of tape or ribbon 32 into the machine 20 to be sewn against the layer of facing material 11*a* during quilting. The ribbon 32 is fed from a spool 33 rotatably supported on a transverse shaft that extends across the front of the machine 20. The ribbon or tape 32 is fed from the spool 33 through a tension device 35 and into the machine 20 on the top of the layer of facing material 11*a*. In the machine 20, chain stitch sequences 13 are sewn with the simultaneous operation of the needle drive 21 and looper drive 25 to join the layers 11*a*, 11*b* and 11*c* together and, at the same time and with some of the same stitch sequences 13 to sew the tape or ribbon 17 to the facing layer 11*a*. As shown in FIG. 3, using the patterns described in connection with the description of the panel 12*b* of FIG. 2B, handles 19 can be formed of the tape 17.

Although only certain exemplary embodiments of this invention have been described in detail above, those skilled in the art will readily appreciate that various modifications can be made without departing from the principles of the present invention. Accordingly, all such modifications are intended to be included within the scope of this invention.

What is claimed is:

1. A mattress cover border panel section comprising:

a facing layer of material;

one or more backing layers or fill layers of material;

a tape strip on a side of the facing layer that is opposite a backing layer or fill layer, the tape strip having two longitudinally extending edges running along the length of the facing layer; and one or more intermittent series of sinuous-shaped chain stitch sequences, each chain stitch sequence securing the facing layer and each of the backing layers or fill layers together, a center stitch sequence of each of the series also securing the facing layer, each of the backing layers or fill layers, and the tape strip to the other layers wherein the center stitch sequence is located entirely within the two longitudinal edges of the tape strip and the other sinuous-shaped chain stitches of each series are located outside the two longitudinal edges and wherein one or more intermittent series of sinuous-shaped chain stitches form a quilting pattern.

2. The mattress cover border panel section of claim 1 wherein:

the center stitch sequences that secure the facing layer, each of the backing layers or fill layers, and the tape strip together are sewn in a series of at least two stitch sequences between which at least a needle thread of which the sequences are formed is cut, a first of the at least two stitch sequences ending in a tack, and a second stitch sequence beginning along the tape spaced at a distance from the tack; and the tape between the tack and the beginning of the second stitch sequence forms a mattress handle.

3. The mattress cover border panel section of claim 2 wherein:

the center stitch sequences that secure the facing layer, each of the backing layers or fill layers, and the tape strip together are sewn in a series of at least three stitch sequences at the end of each of at least two of which is sewn a tack, after which tack at least a needle thread of which the tack is formed is cut, another one of the stitch sequences beginning along the tape spaced at a distance from the tack, so that the tape between the tack and said beginning forms a mattress handle;

whereby at least two mattress handles are formed by the tape along the border panel section.

4. The mattress cover border panel section of claim 3 further comprising a tack at the beginning of each stitch sequence.

5. A rectangular mattress comprising one or more border panels formed of two border panel sections of claim 4, the mattress further comprising:

an interior having a top, a bottom, two side edges, and two end edges;

a top panel on said top of the interior;

a bottom panel on said bottom of the interior; and the one or more border panels joining the top and bottom panels and surrounding the edges, each of the two border panel sections being on one of the side edges of the interior;

the panels forming a mattress cover surrounding the interior and having at least two mattress handles along each of said side edges.

6. The mattress of claim 5 wherein the border panel sections further include a tack at the beginning of each stitch sequence.

7. A rectangular mattress comprising one or more border panels formed of two border panel sections of claim 3, the mattress further comprising:

an interior having a top, a bottom, two side edges, and two end edges;

a top panel on said top of the interior;

a bottom panel on said bottom of the interior; and the one or more border panels joining the top and bottom panels and surrounding the edges, each of the two border panel sections being on one of the side edges of the interior;

the panels forming a mattress cover surrounding the interior and having at least two mattress handles along each of said side edges.

8. A rectangular mattress comprising one or more border panels formed of two border panel sections of claim 1, the mattress further comprising:

an interior having a top, a bottom, two side edges, and two end edges;

a top panel on said top of the interior;

a bottom panel on said bottom of the interior; and the one or more border panels joining the top and bottom panels and surrounding the edges, each of the two border panel sections being on one of the side edges of the interior;

the panels forming a mattress cover surrounding the interior and having at least two mattress handles along each of said side edges.

9. A mattress cover border panel section comprising:

a facing layer of material;

a backing layer of material;

a fill layer of material;

a tape strip having two longitudinally extending edges running along the length of the facing layer; and multiple intermittent series of sinuous-shaped chain stitch sequences vertically spaced from each other, top and bottom chain stitch sequences each securing the facing layer, the backing layer and the fill layer together, a center stitch sequence of each of the series also securing the tape strip to the other layers wherein the center stitch sequence is located entirely within the two longitudinally extending edges of the tape strip and the other series of sinuous-shaped chain stitches are located outside the two longitudinal edges and wherein multiple intermittent series of sinuous-shaped chain stitches form a quilting pattern.

10. A mattress cover border panel section comprising: a facing layer of material; a backing layer of material; a fill layer of material; a tape strip on a side of the facing layer that is opposite a backing layer, the tape strip having two longitudinally extending edges running along the length of the facing layer;

one or more intermittent series of sinuous-shaped chain stitch sequences; and a center stitch sequence is located entirely within the two longitudinal edges of the tape strip and the other series of sinuous-shaped chain stitches are located outside the two longitudinal edges and wherein the one or more intermittent series of sinuous-shaped chain stitches form a quilting pattern.

* * * * *